United States Patent [19]

Weiner

[11] 4,036,651

[45] July 19, 1977

[54] ELECTROLESS COPPER PLATING BATH

[75] Inventor: Joel Alan Weiner, Cranbury, N.J.

[73] Assignee: RCA Corporation, New York, N.Y.

[21] Appl. No.: 445,968

[22] Filed: Feb. 26, 1974

[51] Int. Cl.[2] ..... C23C 3/02

[52] U.S. Cl. ..... 106/1

[58] Field of Search ..... 106/1; 117/130 E

[56] References Cited

U.S. PATENT DOCUMENTS

| | | | |
|---|---|---|---|
| 3,093,509 | 6/1963 | Wein | 117/213 |
| 3,095,309 | 6/1963 | Zeblisky et al. | 106/1 |
| 3,318,711 | 5/1967 | Foulke | 106/1 |
| 3,403,035 | 9/1968 | Schneble et al. | 106/1 |
| 3,615,732 | 10/1971 | Shipley et al. | 106/1 |
| 3,726,707 | 4/1973 | Prosser et al. | 106/1 |

FOREIGN PATENT DOCUMENTS

| | | | |
|---|---|---|---|
| 674,883 | 11/1963 | Canada | 106/1 |

*Primary Examiner*—Lorenzo B. Hayes

*Attorney, Agent, or Firm*—H. Christoffersen; Birgit E. Morris; Joseph T. Harcarik

[57] ABSTRACT

An electroless copper plating bath comprising a copper salt, a chelating agent, an alkali pH adjusting agent, formaldehyde, and sodium hypophosphite as a plating rate accelerator.

4 Claims, No Drawings

ELECTROLESS COPPER PLATING BATH

BACKGROUND OF THE INVENTION

Electroless copper plating has many important commercial applications. One of these is the manufacture of printed circuits by an additive process. Electroless copper plating is also used for providing plastics with decorative metallic coatings.

The most widely used electroless copper plating baths all include formaldehyde as the agent which causes the copper to be reduced from solution. Although these baths are generally satisfactory, it would be desirable to have baths that plate at a faster rate so that more product could be plated without increasing the most of equipment. At the same time, however, the increased plating rate must not be at the cost of greatly decreased bath stability or the addition of expensive ingredients.

The present invention resides in the discovery that if sodium hypophosite is added to conventional formaldehyde-containing electroless copper plating baths in controlled amounts, a significant increase in plating rate can be obtained with very little increase in cost. Although sodium hypophosphite is, itself, a reducing agent in electroless nickel, cobalt, palladium and silver plating baths, it is not a satisfactory reducing agent (i.e., will not reduce $Cu^{++} \rightarrow Cu^{\circ}$) when used alone in alkaline electroless copper plating baths. In the baths of the present invention, the sodium hypophosphite is not used up in the plating reaction. Instead, it appears to act as a catalyst.

The following are examples of plating baths in accordance with the invention. The baths are all aqueous solutions, and all baths are used at 25° C.

EXAMPLE 1

| | |
|---|---|
| $CuSO_4 \cdot 5H_2O$ | 15 g/liter |
| Tetrasodium salt of propylenediamine tetraacetic acid ($PDTANa_4$) (40% solution) | 62 ml/liter |
| NaOH | 4 g/liter |
| $H_2CO$ (37% reagent) | 15 ml/liter |
| $NaH_2PO_2 \cdot H_2O$ | 50 g/liter |

Without the $NaH_2PO_2.H_2O$, the plating rate of the bath was 0.62 mg/cm²/10 min. With the $NaH_2PO_2.H_2O$ it was 0.98 mg/cm²/10 min.

Instead of NaOH any other alkali metal hydroxide or carbonate can be used to adjust the pH of the bath to between about 11 and 13.3.

EXAMPLE 2

| | |
|---|---|
| $CuSO_4 \cdot 5H_2O$ | 15 g/liter |
| $PDTANa_4$ (40% solution) | 62 ml/liter |
| NaOH | 4 g/liter |
| $H_2CO$ (37% reagent) | 15 ml/liter |
| TMN (Tergitol, a non-ionic surfactant) | $4.1 \times 10^{-3}$ g/liter |
| NaCN | $4 \times 10^{-3}$ g/liter |
| $NaH_2PO_2 \cdot H_2O$ | 200 g/liter |

The plating rate of this bath without the $NaH_2PO_2.H_20$ was 0.11 mg/cm²/10 min. With the $NaH_2PO_2.H_2O$ it was 0.22 mg/cm²/10 min.

In this type of bath, the Tergitol is used to improve the physical appearance (brightness) of the deposit. Any other non-ionic surfactant could be substituted. The NaCN is a stabilizer which is present to inhibit bath decomposition. However, the presence of the stabilizer slows down the plating rate appreciably. In this type of bath, the addition of the hypophosphite provides a markedly higher plating rate, the effect on the plating rate being much greater than when no stabilizer is used. Instead of NaCN, other well known stabilizers can be used such as sulfur compounds or lead compounds.

All of these baths also include a chelating agent such as $PDTANa_4$. The chelating agent complexes the copper ions and performs a different function than the stabilizing agent. The compound $PDTANa_4$ belongs to a more general class of compounds having the formula

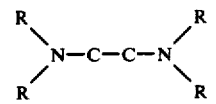

where R is an alkyl group. Any member of this group can be used as well as other well known chelating agents for copper.

EXAMPLE 3

| | |
|---|---|
| $CuSO_4 \cdot 5H_2O$ | 15 g/liter |
| $PDTANa_4$ (40% solution) | 62 ml/liter |
| NaOH | 12 g/liter |
| $H_2CO$ (37% reagent) | 50 ml/liter |
| TMN | $4.1 \times 10^{-3}$ g/liter |
| NaCN | $4.0 \times 10^{-3}$ g/liter |
| $NaH_2PO_2 \cdot H_2O$ | 200 g/liter |

Without the $NaH_2PO_2.H_2O$ the plating rate of this bath was 0.16 mg/cm²/10 min. With the $NaH_2PO_2.H_2O$ it was 0.33 mg/cm²/10 min.

EXAMPLE 4

| | |
|---|---|
| $CuSO_4 \cdot 5H_2O$ | 15 g/liter |
| $PDTANa_4$ (40% solution) | 62 ml/liter |
| NaOH | 4 g/liter |
| $H_2CO$ (37% reagent) | 50 ml/liter |
| TMN | $4.1 \times 10^{-3}$ g/liter |
| NaCN | $4.0 \times 10^{-3}$ g/liter |
| $NaH_2PO_2 \cdot H_2O$ | 200 g/liter |

Without the $NaH_2PO_2.H_2O$ the plating rate of this bath was 0.14 mg/cm²/10 min. With the $NaH_2PO_2.H_2O$ the rate was 0.33 mg/cm²/10 min.

To test the effect on the plating rate of varying the amount of the added $NaH_2PO_2.H_2O$ in a particular plating bath, the following series of experiments was run with the bath:

| | |
|---|---|
| $CuSO_4 \cdot 5H_2O$ | 15 g/liter |
| Ethylenediamine tetraacetic acid ($EDTA \cdot 2H_2O$) | 33 g/liter |
| NaOH | to pH 13 |
| $H_2CO$ (37% reagent) | 15 ml/liter |

Table 1

| Concentration of $NaH_2PO_2 \cdot H_2O$ | % increase in plating rate compared with using no $NaH_2PO_2 \cdot H_2O$ |
|---|---|
| 25 g/liter | 8 |
| 50 g/liter | 16 |
| 100 g/liter | 25 |
| 150 g/liter | 34 |
| 200 g/liter | 34 |
| 250 g/liter | 24 |
| 300 g/liter | 9 |

These results indicate that, for a given bath and a given set of conditions, there is an optimum concentration of $NaH_2PO_2.H_2O$ to obtain an increase in plating rate. More or less than the optimum amount results in less increase or none at all.

When one of the other components of the bath is either varied in amount or a different material is used, the plating rates change and the optimum amount of sodium hypophosphate to use also changes.

The effect of changing the type of chelating agent was also tested. In the following bath, sodium potassium tartrate was used instead of PDTA or EDTA.

EXAMPLE 5

| | |
|---|---|
| $CuSO_4 . 5H_2O$ | 15 g/liter |
| $NaKC_4H_4O_6 . 4H_2O$ (sodium potassium tartrate) | 50 g/liter |
| $H_2CO$ (37% reagent) | 15 ml/liter |
| NaOH | to pH 13 |
| $NaH_2PO_2 . H_2O$ | 150 g/liter |

Without the $NaH_2PO_2.H_2O$ the plating rate was 0.50 mg/cm²/10 min. With the $NaH_2PO_2.H_2O$ the plating rate was 0.69 mg/cm²/10 min.

To test the effect on the plating rate of varying only the formaldehyde concentration and the sodium hypophosphite concentration, the following series of experimental plating runs was made as indicated in Table 2. In the following example the basic bath composition (except for the formaldehyde and the sodium hypophosphite) was:

| | |
|---|---|
| $CuSO_4 . 5H_2O$ | 15.0 g/liter |
| $PDTANa_4$ (40% solution) | 60 ml/liter |
| pH (with NaOH) | 13.3 |

The figures given are percentage differences in plating rates compared to a bath which is the same except that it contains no sodium hypophosphite.

A minus sign before the percentage figure indicates a decrease in plating rate.

Note that the baths did not contain a stabilizer and that the effect of the sodium hypophosphite on the plating rate is less than when a stabilizer is present.

EXAMPLE 6

Table 2

| Concentration of $NaH_2PO_2 . H_2O$ in g/liter | Concentration of 37% formaldehyde in ml/liter | | | | |
|---|---|---|---|---|---|
| | 1.0 | 5.0 | 15.0 | 50.0 | 100.0 |
| | percentage change in plating rate | | | | |
| 25 | 115 | 8 | 19 | 18 | 8 |
| 50 | 184 | 15 | 33 | 20 | 5 |
| 100 | 115 | 14 | 45 | −14 | −19 |
| 200 | 105 | 7 | 5 | −27 | −45 |
| 300 | 69 | −21 | −32 | −61 | −73 |

The reactivity of these baths is directly proportional to the concentration of the formaldehyde. When the bath is highly reactive due to the presence of a relatively high concentration of formaldehyde, the effect of adding sodium hypophosphite on increasing the plating rate tends to be less and, if too much hypophosphite is added, the plating rate is actually decreased.

From the figures that have been given above, it can be concluded that it is not possible to give a definite optimum ratio between the concentration of formaldehyde and the concentration of hypophoshite that will fit all types of baths. A desirable approach to preparing these baths is to measure the plating rate of a given bath which has been provided with the desired components such as chelating agents and stabilizing agents and which has also been provided with a desired concentration of formaldehyde to obtain a certain plating rate and then to add increasing amounts of hypophosphite until the optimum amount has been determined.

In all of the baths of the invention, the concentration of the copper salt is not critical. Preferably, the concentration is between about 0.02 M and 0.2 M.

The concentration of chelating agent also is not critical. Sufficient chelating agent should be included to complex all of the copper ion.

To test the effect on the plating rate of varying the amount of NaOH present in the bath together with varying amounts of $NaH_2PO_2.H_2O$, a series of runs was made with the results shown in Table 3, below.

The basic bath (with the exception of the sodium hypophosphite and sodium hydroxide) was:

| | |
|---|---|
| $CuSO_4 . 5H_2O$ | 15.0 g/liter |
| $PDTANa_4$ (40% solution) | 60.0 ml/liter |
| $H_2CO$ (37% solution) | 15.0 ml/liter |

The plating rate figures are in comparison to a bath which is the same except that no $NaH_2PO_2.H_2O$ is present. A minus sign before the percentage figures indicates a decrease in plating rate.

Table 3

| Concentration of $NaH_2PO_2 . H_2O$ in g/liter | Concentration of NaOH in g/liter | | | |
|---|---|---|---|---|
| | 2.5 | 7.0 | 16 | 40 |
| | Percentage change in plating rate | | | |
| 25 | 32 | 14 | 6 | 10 |
| 50 | 48 | 20 | 13 | 11 |
| 100 | 17 | 39 | 25 | 13 |
| 200 | −1 | 47 | 13 | 30 |
| 300 | −13 | 19 | 9 | 19 |

The results indicate that for a fixed concentration of NaOH there is an optimum concentration of $NaH_2PO_2.H_2O$ for the optimum plating rate.

I claim:

1. A bath for electrolessly depositing copper consisting essentially of a copper salt, a chelating agent for copper ion, sufficient alkali metal hydroxide or carbonate to maintain a pH of about 11–13.3, formaldehyde and sufficient sodium hypophosphite to appreciably increase the copper plating rate of the bath.

2. A bath for electrolessly depositing copper consisting essentially of a copper salt, a chelating agent for copper ion, sufficient alkali metal hydroxide or carbonate to maintain a pH of about 11–13.3, formaldehyde, a surfactant, a stabilizer and sufficient sodium hypophosphite to appreciably increase the copper plating rate of the bath.

3. A bath according to claim 2 in which said stabilizer is NaCN.

4. A bath according to claim 1 in which said amount of hypophosphite is between about 25 and 200 g/liter.

* * * * *